US005337251A

United States Patent [19]

Pastor

[11] Patent Number: 5,337,251

[45] Date of Patent: Aug. 9, 1994

[54] METHOD OF DETECTING A USEFUL SIGNAL AFFECTED BY NOISE

[75] Inventor: Dominique Pastor, Eysines, France

[73] Assignee: Sextant Avionique, Meudon La Foret, France

[21] Appl. No.: 972,445

[22] PCT Filed: Jun. 5, 1992

[86] PCT No.: PCT/FR92/00504

§ 371 Date: Feb. 4, 1993

§ 102(e) Date: Feb. 4, 1993

[87] PCT Pub. No.: WO92/22889

PCT Pub. Date: Dec. 23, 1992

[30] Foreign Application Priority Data

Jun. 14, 1991 [FR] France ..... 91 07323

[51] Int. Cl.[5] ..... G10L 3/00

[52] U.S. Cl. ..... 364/484; 381/46; 381/47; 381/94

[58] Field of Search ..... 364/484, 574; 375/34, 375/76, 99; 381/46, 47, 48, 49, 50, 71, 94; 395/2.23

[56] References Cited

U.S. PATENT DOCUMENTS

| | | | |
|---|---|---|---|
| 4,052,568 | 10/1977 | Jankowski . | |
| 4,359,604 | 11/1982 | Dumont | 179/1 SC |
| 4,410,763 | 10/1983 | Strawczynski et al. . | |
| 4,630,304 | 12/1986 | Borth et al. | 381/94 |
| 4,696,041 | 9/1987 | Sakata | 381/46 |
| 4,799,025 | 1/1989 | Le Quéau | 375/99 |
| 4,914,418 | 4/1990 | Mak et al. | 375/99 |
| 5,029,187 | 7/1991 | Leitch | 375/96 |
| 5,093,842 | 3/1992 | Gimlin et al. | 375/99 |
| 5,097,486 | 3/1992 | Newby et al. | 375/76 |
| 5,142,554 | 8/1992 | Stribling et al. | 375/76 |

OTHER PUBLICATIONS

Ahn et al., "Variable Threshold Detection with Weighted BPSK/PCM Speed Signals Transmitted Over Gaussian Channel", IEEE 1990, pp. 2094–2098.

Wu et al., "Adaptive Pitch Detection Algoritm for Noisy Signals" IEEE 1989, pp. 576–579.

Cai et al., "Energy Detector Performance in a Noise Fluctuating Channel", IEEE 1989, pp. 3.3.1–3.3.5.

IEEE Transactions on Acoustics, Speech, and Signal Processing, vol. ASSP-31, No. 3, Jun. 1983, (New York, US), P. De Souza: "A Statistical Approach to the Design of an Adaptive Self-Normalizing Silence Detector", pp. 678–684, Paragraph III: Training and Adaption.

IBM Technical Disclosure Bulletin, vol. 29, No. 12, May 1987, (Armonk, N.Y., US): "Digital Signal Processing Algorithm for Microphone Input Energy Detection Having Adaptive Sensitivity", pp. 5606–5609.

*Primary Examiner*—Thomas G. Black
*Assistant Examiner*—Tan Q. Nguyen
*Attorney, Agent, or Firm*—Oblon, Spivak, McClelland, Maier & Neustadt

[57] ABSTRACT

In order to detect a useful signal affected by noise, a measurement is taken of the expected S/N ratio of this signal over a time slice, a measurement of the estimated white noise alone is taken over another time slice without useful signal, the mean energy of the noise and of the noise-affected signal is calculated, in each of their time slices, the theoretical detection threshold is calculated, the ratio of these two energies is calculated, and the ratio is compared with the calculated threshold, this threshold being greater than 1 (ideal threshold).

19 Claims, 3 Drawing Sheets

METHOD OF DETECTING A USEFUL SIGNAL AFFECTED BY NOISE

BACKGROUND OF THE INVENTION

1. Field of the Invention

The present invention relates to a method of detecting a useful signal affected by noise.

2. Discussion of the Background

One of the great problems in signal processing, simple to enunciate but very complex to resolve, consists in determining the presence or the absence of a useful signal buried in additive noise.

Various solutions can be envisaged. It is possible to use, as a variable, the instantaneous amplitude of the received or processed signal by reference to an experimentally-determined threshold.

It is also possible to use, as a variable, the energy of the total signal over a time slice of duration T, by thresholding this energy, still experimentally.

These thresholdings allow a first assumption on the presence or the absence of the signal. They are, moreover, applicable to any signal. Hence, they are complemented by "confirmation" systems, defining "near-certain" criteria, specific to the type of useful signal, when the nature of the latter is known in advance.

Such a complementary system is widely used in speech processing and may consist, for example, in extraction of "pitch" or in evaluation of the minimum energy of a vowel.

SUMMARY OF THE INVENTION

The subject of the present invention is a method of detecting a useful signal affected by noise, determining the detection threshold as rigourousiy as possible, and able to operate self-adaptively.

According to the invention, the expected signal/-noise ratio of the signal to be processed is available, and a measurement of the estimated noise alone is available, a measurement enumerated over M points, this noise being white or made to be white, the mean energy of the noise over these M points is calculated, a slice of N points of noise-affected signal is taken, the mean energy of these N points is calculated, the theoretical detection threshold is calculated, the ratio between the two said mean energies is calculated, and this ratio is compared with the said threshold.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

THE DESCRIPTION OF THE PREFERRED EMBODIMENTS

Figure 1:
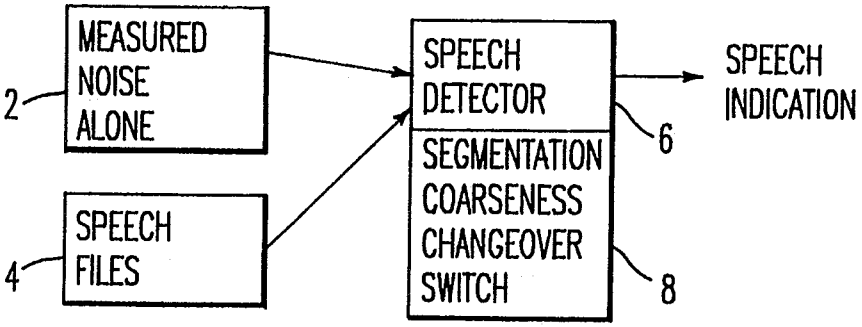
FIG. 1 illustrates an exemplary embodiment of the invention.

Referring now to the drawings, wherein like reference numerals designate identical or corresponding parts throughout the several view, and more particularly to FIG. 1 thereof, there is illustrated an exemplary hardware embodiment of the present invention. Reference No. 6 designates a speech detector which detects if speech is contained in an input audio sample. The algorithm used by the speech detector 6 requires a measurement of noise alone 2 and a signal which may or may not contain speech. Speech files 4 contain the audio samples/signals which may or may not contain speech. The audio samples can be mixed with noise. The speech detector 6 contains a segmentation coarseness changeover switch 8 which determines if diction of the speech files is to be segmented in a coarse manner.

Figure 2:
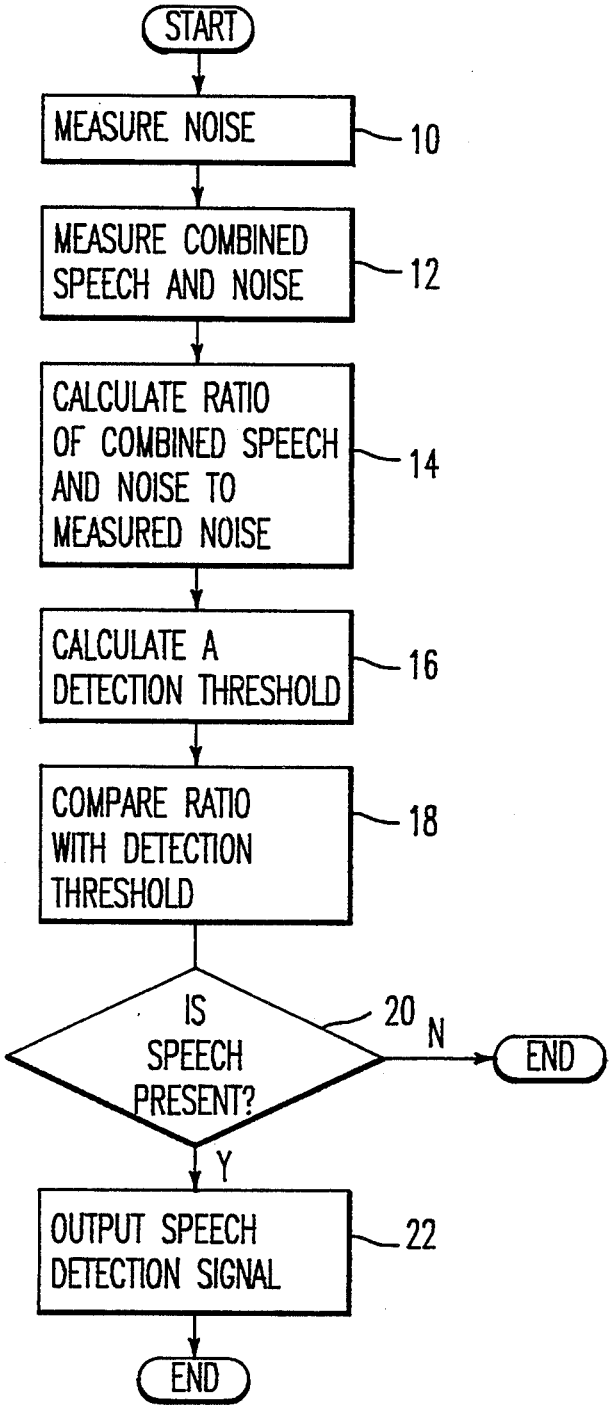
FIG. 2 illustrates a process used by the present invention.

FIG. 2 illustrates a process which is performed by the present invention. First, in step 10, a signal which is noise alone is measured. In step 12, a combined speech and noise signal is measured. Step 14 then calculates a ratio of the energy of the combined speech and noise signal to the energy of the measured noise signal. Step 16 then calculates a detection threshold which is described in detail below, and step 18 compares the ratio calculated in step 14 with the detection threshold calculated in step 16.

Step 20 then determines if speech is present using the comparison result of step 18. If there is no speech present, the process ends. If step 20 indicates speech is present, flow proceeds to step 22 which outputs a speech detection signal.

Figure 3:
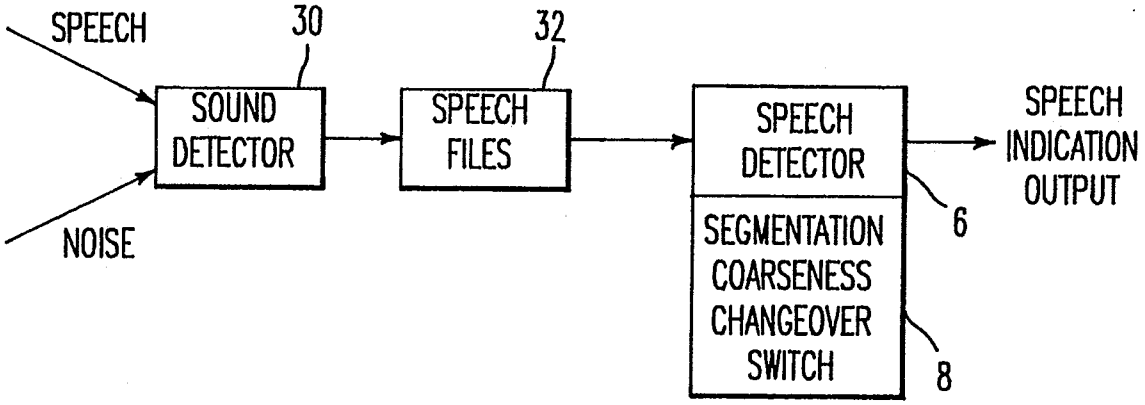
FIG. 3 illustrates a second embodiment of the present invention.

FIG. 3 illustrates a second embodiment of the invention. The speech detector 6 and segmentation coarseness changeover switch 8 in FIG. 3 operate in a similar manner as elements 6 and 8 illustrated in FIG. 1. The reference No. 2 designates a conventional sound detector which has input thereto both speech and noise signals. The output from the sound detector 2 is connected to the speech files 4 which can store the detected sound for later processing. When the speech detector 6 detects a useful signal such as speech, it outputs a signal indicating speech has been detected.

First of all, it will be explained how, in the ideal case, detection of a signal affected by noise should theoretically be done.

A first item of information u(n) is available for a first time slice such that:

$$u(n)=s(n)+x(n)$$

n being a whole number: $0 \leqq n \leqq N-1$, s(n) being a useful signal and x(n) noise. Moreover, another item of information y(n) is available, with $0 \leqq n \leqq M-1$, and M possibly being equal to or different from N. y(n) is a measure of the noise x(n) over another time slice devoid of useful signal.

$$\text{Then: } U = (u(0)^2 + u(1)^2 + \ldots + u(N)^2)/N \text{ and}$$
$$V = (y(0)^2 + y(1)^2 + \ldots + y(M)^2)/M \text{ and}$$
$$Z = U/V$$

Hence, in an ideal and unrealistic case, this would give, with SNR=signal-to-noise ratio:

$$Z=1+SNR$$

and the simple detection criterion would be:

$Z>1$: presence of useful signal $Z<1$: absence of useful signal

According to the present invention, the theoretical threshold of 1 is replaced by a threshold $\mu$, calculated as explained below, which takes account of the fact that the signals available are not perfectly ergodic and that U and V are only estimates of the true value of the variances $\sigma_u 2$ and $\sigma_x 2$.

In order to calculate $\mu$, the following method is used.

Starting with the fact that the variables U and V are random in nature, and that consequently Z also is, then the probability density of Z (which depends on the signal-to-noise ratio) is calculated.

It is then a question, by invoking the principle of maximum likelihood, of determining the best estimate of the signal-to-noise ratio after having calculated the variable Z.

To this end, the abovementioned variable U(n) is measured over one time slice, and the variable y(n) is measured over another time slice in which it is certain that there is no useful signal, but only noise (independent of and decorrelated with s(n)).

In order to determine the density of the random variable Z (which may be described as observed variable), the following method is used. Let $X_1$ belonging to N ($m_1$; $\sigma_1^2$) and $X_2$ belonging to N ($m_2$; $\sigma_2^2$) be two independent gaussian random variables for which the probabilities $P_r\{X_1<0\}$ and $P_r\{X_2<0\}$ are practically zero.

Then: $m=m_1/m_2$, $\sigma^2=\sigma_1^2/\sigma_2^2$, $\alpha=m_2/\sigma_2$.

The probability density $f_x(x)$ of X is then:

$$f_x(x) = \left(\frac{1}{2\pi}\right)^{-\frac{1}{2}} \frac{mx + \sigma^2}{(x^2 + \sigma^2)^{3/2}} \cdot e^{-\frac{\alpha 2}{2} \cdot \frac{(x-m)2}{x2+\sigma 2}} \cdot U(x)$$

where U(x)=1 if x≧0 and U(x)=0 if x<0.

$$\text{If } h(x) = \alpha \cdot \frac{x - m}{(x^2 + \sigma^2)^{\frac{1}{2}}}$$

then: $P(x)=P_r\{X<x\}=F[h(x)]$, an expression in which F(x) designates the characteristic function of the normalised gaussian variable.

Supposing now that the signals s(n), x(n) and y(n) are white, gaussian and centred.

$$\text{Then } \sigma_s^2 = E[s(n)^2]$$
$$\sigma_x^2 = E[x(n)^2] = E[y(n)^2] \cdot u(n) = s(n) + x(n).$$

This latter term is, therefore, itself also white, gaussian and centred;

$$\text{and then } \sigma_u^2 = E[u(n)^2] = \sigma_s^2 + \sigma_x^2$$

Since $\sigma_s^2$ and $\sigma_x^2$ are defined, it is assumed implicitly that calculation of the probability density is done with known $\sigma_s^2$ and $\sigma_x^2$. Thus the density of Z is evaluated knowing $\sigma_s^2$ and $\sigma_x^2$. In this case, U and V follow the chi-2 (sic) laws, and, for sufficiently large N and M, U and V are approximated by gaussian laws which are practically always positive:

$$U \text{ belongs to } N(\sigma_u^2; 2\sigma_u^4/N) \text{ and } V \text{ to } N(\sigma_x^2; 2\sigma_x^4/M)$$

Z is therefore the ratio of two independent gaussian variables. It can easily be demonstrated that U and V are independent.

$$\text{With: } m_1 = \sigma_u^2, \sigma_1^2 = 2\sigma_u^4/N, m_2 = \sigma_x^2, \sigma_2^2 = 2\sigma_x^4/M$$

-continued this gives: $m = \sigma_u^2/\sigma_x^2$, $\sigma^2 = (M/N)(\sigma_u^2/\sigma_x^2)^2$, $\alpha = (M/2)^{\frac{1}{2}}$.

Now: $\sigma_u^2/\sigma_x^2 = 1 + r$ where $r = \sigma_s^2/\sigma_x^2$ is the signal-to-noise ratio. Let $k = M/N$, then: $m = r + 1$, $\sigma^2 = k(r + 1)^2$.

The probabililty density of Z, knowing $\sigma_s^2$ and $\sigma_x^2$, is hence expressed by:

1°) $x \geqq 0$ $$f_z(z:\sigma_s^2, \sigma_x^2) = (M/4\pi)^{\frac{1}{2}} (r + 1) \frac{z + k(1 + r)}{[z^2 + k(r + 1)^2]^{3/2}} e^{-\frac{M[z-(r+1)]2}{4[z2+k(r+1)2]}}$$

2°) $x \leqq 0$ whence: $f_z(z:\sigma_s^2, \sigma_x^2) = 0$

Setting:

$$f_{k,M}(z,r) = (M/4\pi)^{\frac{1}{2}} (r + 1) \frac{z + k(1 + r)}{[z^2 + k(r + 1)^2]^{3/2}} e^{-\frac{M[z-(r+1)]2}{4[z2+k(r+1)2]}} U(z)$$

such that: $f_z(z:\sigma_s^2, \sigma_x^2)=f_{k,M}(z,\sigma_s^2/\sigma_x^2)$

According to the results above relating to the probability density of Z, the probability is deduced.

$$Pr\{Z < z:\sigma_s^2, \sigma_x^2\}.$$

$$\text{Let: } h_{k,M}(x,r) = (M/2)^{\frac{1}{2}} \frac{x - (r + 1)}{[x^2 + k(r + 1)^2]^{\frac{1}{2}}}$$

This gives: $P_r\{Z<z: \sigma_s^2; \sigma_x^2\}=F\{h_{k,M}(x,r)\}$.

The case of any signal s(n) and a gaussian white noise will now be examined.

Still assuming that the noises x(n) and y(n) are white, gaussian with $\sigma_x^2=E[x(n)^2]=E[y(n)^2]$. The useful signal s(n) is assumed to be any signal whatever, independent of the noise.

The new hypothesis used here is to assume that s(n) and x(n) are not correlated in the time sense of the term, that is to say that:

$$c = \frac{\Sigma 0 \leqq n \leqq N - 1\, s(n) \times (n)}{(\Sigma 0 \leqq n \leqq N - 1\, s(n)^2)^{\frac{1}{2}} (\Sigma 0 \leqq n \leqq N - 1\, x(n)^2)^{\frac{1}{2}}} = 0$$

It is then shown that $U$ may be approximated by:

$$U = \mu_s^2 + (1/N)\, \Sigma 0 \leqq n \leqq N - 1\, x(n)^2$$

$$Z = \frac{\mu_s^2 + (1/N)\, \Sigma 0 \leqq n \leqq N - 1\, x(n)^2}{(1/M)\, \Sigma 0 \leqq n \leqq M - 1\, y(n)^2}$$

In the same way as before, the calculation of the density of Z was done while knowing $\sigma_s^2$ and $\sigma_s^2$, here the calculation will be performed while knowing $\mu_s^2$ and $\sigma_x^2$. The density to be calculated will be denoted by $f_z(z:\mu_s^2, \sigma_x^2)$.

Knowing $\mu_s^2$, $U=\mu_s^2+(1/N)\ \Sigma\ 0\leqq n\leqq N\text{-}1\ x(n)^2$ belongs to $N(\mu_s^2+\sigma_x^2; (2/N)\ \sigma_x^4)$. V belongs to $N(\sigma_x^2; (2/M)\ \sigma_x^4)$.

Z=U/V is thus approximated by the ratio of two independent gaussian laws. As U and V are independent, the result relating to the probability density of X is applied, with:

$$m_1 = \mu_s^2 + \sigma_x^2, \sigma_1^2 = (2/N)\, \sigma_x^4,$$

-continued $m_2 = \sigma_x^2, \sigma_2^2 = (2/M)\sigma_x^4$

Hence:

$m = r + 1, \sigma^2 = k, \alpha = (M/2)^{1/2}$, with $k = M/N$ and $r = \mu_s^2/\sigma_x^2$.

The probability density of Z, knowing $\mu_s^2$ and $\sigma_x^2$ is then equal to:

$$f_2(z:\mu_s^2, \sigma_x^2) = (M/4\pi)^{1/2} \frac{(1 + r)z + k}{[z^2 + k]^{3/2}} e^{-\frac{M}{4} \frac{[z-(r+1)]2}{z2+k}} U(z)$$

Then:

$$f_{k,M}(z) = (M/4\pi)^{1/2} \frac{(1 + r)z + k}{[z^2 + k]^{3/2}} e^{-\frac{M}{4} \frac{[z-(r+1)]2}{z2+k}} U(z)$$

such that: $f_z(z:\sigma_s^2, \sigma_x^2)=f_{k,M}(z, \sigma_s^2/\sigma_x^2)$

According to the results above relating to the probability density of X, the probability is deduced therefrom $$Pr\{Z < z: \mu_s^2, \sigma_x^2\}.$$

Let: $h_{k,M}(x,r) = (M/2)^{1/2} \frac{x - (r + 1)}{[x^2 + k]^{1/2}}$

This gives: $P_r\{Z<z: \mu_s, \sigma_x^2\}=F(h_{k,M}(x,r))$

According to the present invention, activity detection is implemented by having recourse to the likelihood maximum.

In the case of processed signals, the probability density of the variable Z, knowing the energies of the useful signal and of the noise, is expressed by a function of the form: $f_{k,M}(z,r)$ where r designates the signal-to-noise ratio. This probability therefore depends on the signal-to-noise ratio. In addition, the decision rule can only be given with expected signal-to-noise ratio. Therefore let $r_0$ by this expected signal-to-noise ratio.

Assume that the probability of absence of s(n) is $\pi_0$ and that the probability of presence of s(n) is $\pi_1$.

Since the probability density $f_k,(z,r)$ is known, the optimum decision rule is given by the general theory of detection and is expressed by:

$$\frac{\pi_1 f_{k,M}(z,r_o)}{\pi_o f_{k,M}(z,0)} > 1 \rightarrow D = 1$$

$$\frac{\pi_1 f_{k,M}(z,r_o)}{\pi_o f_{k,M}(z,0)} < 1 \rightarrow D = 0$$

It is also possible to express this decision rule in the form: $(Z<\mu\rightarrow D=0)$ and $(Z>\mu\rightarrow D=1)$.

It is then necessary to determine $\mu$ and solve the equation:

$$1n[f_{k,M}(z,r_0)]-1n[f_{k,}(z,0)]-1n(\pi_0,\pi_1)=0.$$

It is then shown that the error probability is equal to:

$$Pe=\pi_0 [1-F(h_{k,M}(\mu,0))]+\pi_1 F(h_{k,M}(\mu,r_0)).$$

The case of the detection of a gaussian white signal in noise which is itself gaussian and white will now be examined.

The signals s(n), x(n) and y(n) are assumed to be white, gaussian and centered. Let $r_0$ be the expected signal-to-noise ratio, and k=M/N. The probability of absence of s(n) is $\pi_0$ and the probability of presence of s(n) is $\pi_1$.

The decision rule is then:

Decision $D = 1$ when:

$$\frac{\pi_1 f_{k,M}(z,r_o)}{\pi_o f_{k,M}(z,0)} > 1 \rightarrow D = 1$$

Decision $D = 0$ when:

$$\frac{\pi_1 f_{k,M}(z,r_o)}{\pi_o f_{k,M}(z,0)} < 1 \rightarrow D = 0$$

The threshold being determined for equality (instead of inequality) between the terms of these two expressions.

It is also possible to express this decision rule in the form: $(Z<\mu\rightarrow D=0)$ and $(Z>\mu\rightarrow D=1)$. For $\mu$, with $M=N=128$, $\pi_0=\pi_1=\frac{1}{2}$ there is obtained, for example:

| $r_0$ in dB | $\mu$ |
|---|---|
| −2 | 1.27 |
| −1 | 1.34 |
| 0 | 1.41 |
| 1 | 1.50 |
| 2 | 1.68 |

The error probability is: $Pe=\pi_0 [1-F(h_{k,M}(\mu,0))]+\pi_1 F(h_{k,M}(\mu,r0))$ with:

$$h_{k,M}(x,r) = (M/2)^{1/2} \frac{x - (r + 1)}{[x^2 + k (r + 1)^2]^{1/2}}$$

Below are given a few values of Pe as a function of $r_0$. $\pi_0$ and $\pi_1$ are taken to be equal to 0.5.

| $r_0$ in dB | Pe |
|---|---|
| −2 | 0.086 |
| −1 | 0.052 |
| 0 | 0.028 |
| 1 | 0.013 |
| 2 | 0.005 |

In one simulation example, gaussian white noise with unity variance was generated. For each frame of 128 points (N=M=128), it was decided at random to generate additive noise s(n), exhibiting a signal-to-noise ratio defined in advance. The appearance and absence probabilities ($\pi_0$ and $\pi_1$) are equal to 0.5. A second gaussian white noise with unity variance was generated, which served for calculating the random variable V. Z was calculated for each frame. Then the decision rule was applied and the number of errors was counted.

| $r_0$ in dB | Number of errors over 1000 iterations |
|---|---|
| −2 | 73 |
| −1 | 43 |
| 0 | 18 |
| 1 | 10 |
| 2 | 2 |

These results corroborate those anticipated from the theoretical calculation.

The case of any signal s(n) and a gaussian white noise will now be examined.

It is still assumed that the noises x(n) and y(n) are white, gaussian with $\sigma_x^2=E[x(n)^2]=E[y(n)^2]$. The useful signal s(n) is assumed to be any signal whatever, independent of the noise. Let $r_0$ be the signal-to-noise ratio expected, k=M/N. The probability of absence of s(n) is $\sigma_0$ and that of presence of s(n) is $\pi_1$.

The decision rule then is:

Decision $D = 1$ when:

$$\ln\frac{(r+1)z+k}{z+k} > (M/4)\frac{[z-(r_o+1)]^2-(z-1)^2}{z^2+k} + \ln\frac{\pi_o}{\pi_1}$$

Decision $D = \theta$ when:

$$\ln\frac{(r+1)z+k}{z+k} < (M/4)\frac{[z-(r_o+1)]^2-(z-1)^2}{z^2+k} + \ln\frac{\pi_o}{\pi_1}$$

It is also possible to express this decision rule in the form: $(Z<\mu\rightarrow D=0)$ and $(Z>\mu\rightarrow D=1)$.

For $\mu$ the following values are obtained as a function of $r_0$, for $M=N=128$, $\pi_0=\pi_1=\frac{1}{2}$.

| $r_0$ in dB | $\mu$ |
|---|---|
| −2 | 1.30 |
| −1 | 1.38 |
| 0 | 1.48 |
| 1 | 1.60 |
| 2 | 1.76 |

Then, moreover:

$$Pe = \pi_0[1 - F(h_{k,M}(\mu,0))] + \pi_1 F(h_{k,M}(\mu, r_0))$$

with:

$$h_{k,M}(x,r) = (M/2)^{1/2}\frac{x-(r+1)}{[x^2+k]^{1/2}}$$

Several values of Pe as a function of $r_0$ are given below. The probabilities $\pi_0$ and $\pi_1$ are taken to be equal to 0.5.

| $r_0$ in dB | Pe |
|---|---|
| −2 | 0.062 |
| −1 | 0.032 |
| 0 | 0.013 |
| 1 | 0.004 |
| 2 | 0.001 |

In one simulation example, for each frame of 128 points of white noise generated (N=M=128), it was decided at random to add s(n) to it, which, here, is a sinusoid, exhibiting a signal-to-noise ratio defined in advance. $\pi_1$ and $\pi_0$ are taken to be equal to 0.5.

A second white noise with unity variance was generated, serving to calculate V. For each frame, Z was calculated and the abovementioned decision rule was applied. The number of errors was counted.

The following results were obtained:

| $r_0$ in dB | Number of errors over 1000 iterations |
|---|---|
| −2 | 70 |
| −1 | 37 |
| 0 | 12 |
| 1 | 6 |
| 2 | 3 |

These results corroborate those anticipated from the theoretical calculation.

The preceding results, being very general, allow the detection of signals buried in additive noise, even when the signal-to-noise ratio is low, close to 0 dB.

An application will be described below, in which this type of detection may be seen to be very useful.

The algorithms presented apply to the case of speech, as a pre-system for detection of vocal activity.

The choice of the detection threshold depends on the context.

As far as the audio bands used are concerned, a preliminary characterisation of noise and speech, with the aid of measurements based on estimation by maximum likelihood, shows that the vocal signal to be detected exhibits a signal-to-noise ratio of at least 6 dB.

Moreover, the processing system uses signal frames of 128 points, the sampling frequency being 10 kHz.

The variables U and V are both evaluated over 128 points, such that M=N=128.

According to the foregoing, the theoretical detection threshold is deduced at 3.

However, it is impossible to be restricted to this single threshold. In fact, if the noise is relatively stationary, it exhibits non-stationary features to be taken into account in order to renew the variable V, which makes it possible to make the algorithm partially adaptive.

Hence a second threshold is introduced, which makes it possible to decide whether the variable V will be renewed or not.

This second threshold is chosen to be 1.25, which corresponds to a noise which adds to the stationary noise exhibiting a signal-to-noise ratio of −2 dB.

The decision rule is then:

If $Z<1.25$

The processed frame then consists of the same noise as that used as reference. The variable V is replaced by the value of the energy of the processed frame.

It will be noted that, since the decision is to consider the processed frame as representative noise, it would be possible to renew the variable V by forming the mean of the former value of V and of the energy of the frame in question. This leads to changing the value of M (number of points over which V is evaluated) but this operation may induce incorrect operation of the algorithm.

If $1.25<Z<3$

The frame is considered as containing non-stationary noise, and devoid of speech.

If $3<Z$

The frame is considered to be speech.

Tests carried out on samples of signals affected by noise have validated this detection.

However, it is recalled that this vocal detection may be improved by use of criteria specific to the speech signal, such as the calculation of "pitch".

The algorithm proposed here concerns the investigation of several examples of signals. It is obvious that for other speech signals exhibiting different signal-to-noise ratios, a new choice of threshold is necessary.

The use of two thresholds is generally preferable.

One application of this algorithm makes it possible to create correct reference files for the voice recognition system in question. Precise segmentation of diction is then necessary.

In one application, a changeover microswitch (microswitch opening and closing) which delivers coarse segmentation of diction.

The preceding algorithm has been used to refine this changeover switch. A first pass of the algorithm made it possible to specify the start of the dictions. A second pass consisted in reading the speech file "backwards", that is to say starting with the microswitch closure towards microswitch opening. This also made it possible to specify the end of the diction.

This non-causal use of the algorithm is necessary, as activity detection sufficiently precise to detect, inside words, the presence of silences, which is prejudicial to implementing segmentation for the learning phases.

The same type of application also makes at possible to segment the speech files on which recognition is carried out.

However, this algorithm is obviously not causal, which is prejudicial for real-time use. Hence the necessity of completing this algorithm by a calculation specific to speech processing.

We have demonstrated the existence of optimal detection thresholds, which makes it possible to have a theoretical approach to the problem of estimating the signal-to-noise ratio and, above all of detection, in the case of white noise and a signal which is known only from its energy over N points when the latter remains relatively stationary.

I claim:

1. A method for detecting if speech is present in an audio sample, comprising the steps of:

detecting noise and generating a noise signal;

detecting an audio sample which includes both speech and noise and generating an audio signal;

determining an energy of the noise signal;

determining an energy of the audio signal;

calculating a ratio of the energy of the audio signal to the energy of the noise signal;

calculating a detection threshold; and comparing the calculated ratio with the calculated detection threshold and outputting a comparison result which indicates one of a presence and absence of speech in the audio sample.

2. A method according to claim 1, further comprising the step of:

calculating a second detection threshold;

wherein said comparing step comprises the substeps of:

comparing the calculated ratio with the first calculated detection threshold and outputting a first comparison result; and comparing the calculated ratio with the second calculated detection threshold and outputting a second comparison result; and wherein said outputting of the comparison result outputs the comparison result using both said first and second comparison results.

3. A method according to claim 1, further comprising the steps of:

determining if said noise signal is a white noise signal; and converting said noise signal to a noise signal containing white noise, when said step of determining if said noise signal is a white noise signal determines that said noise signal is not a white noise signal.

4. A method according to claim 1, wherein:

said step of determining the energy of the noise signal determines the energy of the noise signal over N sampling slices; and said step of determining the energy of the audio signal determines the energy of the audio signal over M sampling slices.

5. A method according to claim 4, wherein:

the step of calculating the detection threshold calculates the detection threshold for:

$$\ln\frac{(r+1)z+k}{z+k} = (M/4)\frac{[z-(r_o+1)]^2-(z-1)^2}{z^2+k} + \ln\frac{\pi_o}{\pi_1}$$

where $r_0$ is an expected signal to noise ratio, $K=M/N$, $\pi_0$ is a probability of an absence of the useful signal, and $\pi_1$ is a probability of a presence of the useful signal.

6. A method according to claim 4, wherein:

the step of calculating the detection threshold calculates the detection threshold for:

$$\ln\left[(r+1)\frac{[z+k(r_O+1)]\,(z^2+k)^{3/2}}{(z+k)\,[z^2+k\,(r_o+1)^2]^{3/2}}\right] = (M/4)\left[\frac{[z-(r_o+1)]^2}{z^2+k\,(r_o+1)^2}-\frac{(z-1)^2}{z^2+k}\right]+\ln\frac{\pi_o}{\pi_1}$$

where $r_0$ is an expected signal to noise ratio, $K=M/N$, $\pi_0$ is a probability of an absence of the useful signal, and $\pi_1$ is a probability of a presence of the useful signal.

7. An apparatus for detecting if speech is present in an audio sample, comprising:

first energy determination means for determining an energy of a measured noise signal;

a speech file for storing an audio sample which includes both speech and noise;

second energy determination means, connected to the speech file for determining an energy of the stored audio sample;

first calculating means for calculating a ratio of the energy of the stored audio sample to an energy of the noise signal, connected to the first and second energy determination means;

second calculating means for calculating a detection threshold; and means for comparing the calculated ratio with the calculated detection threshold and outputting a comparison result which indicates one of a presence and absence of speech in the audio sample, connected to the first and second calculating means.

8. An apparatus according to claim 7, further comprising:

means for calculating a second detection threshold, connected to said comparing means;

wherein said comparing means comprises:

means for comparing the calculated ratio with the first calculated detection threshold and outputting a first comparison result; and means for comparing the calculated ratio with the second calculated detection threshold and outputting a second comparison result; and wherein said outputting of the comparison result by the comparing means outputs the comparison result using both said first and second comparison results.

9. An apparatus according to claim 7, further comprising:

white noise determination means for determining if said noise signal is a white noise signal, connected to the first energy determination means;

conversion means, connected to said white noise determination means and said first energy detection means, for converting said noise signal to a noise signal containing white noise.

10. An apparatus according to claim 7, wherein:

said first energy determination means determines the energy of the noise signal over N sampling slices; and said second energy determination means determines the energy of the audio signal over M sampling slices.

11. An apparatus according to claim 10, wherein:

the means for calculating the detection threshold calculates the detection threshold for:

$$\ln \frac{(r+1)z+k}{z+k} = (M/4)\frac{[z-(r_o+1)]^2-(z-1)^2}{z^2+k} + \ln \frac{\pi_o}{\pi_1}$$

where $r_0$ is an expected signal to noise ratio, $k=M/N$, $\pi_0$ is a probability of an absence of the useful signal, and $\pi_1$ is a probability of a presence of the useful signal.

12. An apparatus according to claim 10, wherein:

the means for calculating the detection threshold calculates the detection threshold for:

$$\ln\left[(r+1)\frac{[z+k(r_O+1)](z^2+k)^{3/2}}{(z+k)[z^2+k(r_o+1)^2]^{3/2}}\right] = (M/4)\left[\frac{[z-(r_o+1)]^2}{z^2+k(r_o+1)^2} - \frac{(z-1)^2}{z^2+k}\right] + \ln\frac{\pi_o}{\pi_1}$$

where $r_0$ is an expected signal to noise ratio, $k=M/N$, $\pi_0$ is a probability of an absence of the useful signal, and $\pi_1$ is a probability of a presence of the useful signal.

13. An apparatus according to claim 7, further comprising:

a segmentation means, connected to the speech file, for segmenting diction contained in the speech file; and a switch connected to the segmentation means;

wherein a coarseness of segmentation performed by the segmentation means is determined using a setting of said switch.

14. An apparatus for detecting if speech is present in an audio sample, comprising:

first energy determination means for determining an energy of a measured noise signal;

a sound detector;

second energy determination means, connected to the sound detector, for determining an energy an audio sample containing noise and speech detected by the sound detector;

first calculating means, connected to the first and second energy determination means, for calculating a ratio of the energy of the audio sample to an energy of the noise signal, connected to the first and second energy determination means;

second calculating means for calculating a detection threshold; and means for comparing the calculated ratio with the calculated detection threshold and outputting a comparison result which indicates one of a presence and absence of speech in the audio sample, connected to the first and second calculating means.

15. An apparatus according to claim 14, further comprising:

means for calculating a second detection threshold;

wherein said comparing means comprises:

means for comparing the calculated ratio with the first calculated detection threshold and outputting a first comparison result; and means for comparing the calculated ratio with the second calculated detection threshold and outputting a second comparison result; and wherein said outputting of the comparison result by the comparing means outputs the comparison result using both said first and second comparison results.

16. An apparatus according to claim 14, further comprising:

white noise determination means for determining if said noise signal is a white noise signal, connected to the first energy determination means;

conversion means, connected to said white noise determination means and said first energy detection means, for converting said noise signal to a noise signal containing white noise.

17. An apparatus according to claim 14, wherein:

said first energy determination means determines the energy of the noise signal over N sampling slices; and said second energy determination means determines the energy of the audio signal over M sampling slices.

18. An apparatus according to claim 17, wherein:

the means for calculating the detection threshold calculates the detection threshold for:

$$\ln \frac{(r+1)z+k}{z+k} = (M/4)\frac{[z-(r_o+1)]^2-(z-1)^2}{z^2+k} + \ln \frac{\pi_o}{\pi_1}$$

where $r_0$ is an expected signal to noise ratio, $k=M/N$, $\pi_0$ is a probability of an absence of the useful signal, and $\pi_1$ is a probability of a presence of the useful signal.

19. An apparatus according to claim 17, wherein:

the means for calculating the detection threshold calculates the detection threshold for:

$$\ln\left[(r+1)\frac{[z+k(r_O+1)]\,(z^2+k)^{3/2}}{(z+k)\,[z^2+k\,(r_o+1)^2]^{3/2}}\right]=$$

-continued $$(M/4)\left[\frac{[z-(r_o+1)]^2}{z^2+k\,(r_o+1)^2}-\frac{(z-1)^2}{z^2+k}\right]+\ln\frac{\pi_o}{\pi_1}$$

where $r_0$ is an expected signal to noise ratio, $k=M/N$, $\pi_0$ is a probability of an absence of the useful signal, and $\pi_1$ is a probability of a presence of the useful signal.

* * * * *